US006405881B1

(12) United States Patent
Park

(10) Patent No.: US 6,405,881 B1
(45) **Date of Patent: *Jun. 18, 2002**

(54) HOLDER FOR ASSORTED WORKSHOP ARTICLES

(76) Inventor: Hong Ku Park, 203 Southcrest Dr., Huntsville, AL (US) 35802

( * ) Notice: Subject to any disclaimer, the term of this patent is extended or adjusted under 35 U.S.C. 154(b) by 0 days.

This patent is subject to a terminal disclaimer.

(21) Appl. No.: 09/594,272

(22) Filed: Jun. 15, 2000

(51) Int. Cl.[7] ..... A47G 29/00
(52) U.S. Cl. ..... 211/71.01; 211/70.6; 211/87.01
(58) Field of Search ..... 211/71.01, 81, 211/70.6, 90.01, 87.01; 248/317, 339, 311.2, 309.1, 318; 47/81, 79; 206/214

(56) References Cited

U.S. PATENT DOCUMENTS 88,777 A * 4/1869 Doudna ..... 211/90.01 X
476,029 A * 5/1892 Altman ..... 211/113
898,091 A * 9/1908 Carney ..... 312/248
2,475,442 A * 7/1949 Baum ..... 223/95
3,638,849 A * 2/1972 Goings ..... 229/28 R
3,825,126 A * 7/1974 Pohl et al. ..... 211/71.01
4,360,231 A * 11/1982 Bolin ..... 294/87.2
4,695,029 A * 9/1987 Fox et al. ..... 248/360
4,793,097 A * 12/1988 Whitcomb ..... 47/86
4,803,806 A * 2/1989 Ito ..... 47/39
5,102,085 A * 4/1992 Wieczorek et al. ..... 248/311.2
5,285,991 A * 2/1994 Carlson ..... 248/311.2
5,404,800 A * 4/1995 Hsu ..... 99/426
5,730,522 A * 3/1998 Wyke et al. ..... 362/432
5,791,617 A * 8/1998 Boman et al. ..... 248/311.2
5,839,711 A * 11/1998 Bieck et al. ..... 248/313
5,860,630 A * 1/1999 Wildey et al. ..... 248/311.2
5,897,041 A * 4/1999 Ney et al. ..... 224/483
6,021,987 A * 2/2000 Shimota ..... 248/311.2
6,116,434 A * 9/2000 Park ..... 211/71.01

* cited by examiner

*Primary Examiner*—Daniel P. Stodola
*Assistant Examiner*—Khoa Tran

(57) ABSTRACT

A holder for assorted workshop articles such as tools, small parts, bolts, nuts, screw, pencils, and rulers. The holder comprises a wall hanger, a plurality of insert rings, a plurality of cup-shaped containers.

10 Claims, 5 Drawing Sheets

HOLDER FOR ASSORTED WORKSHOP ARTICLES

FIELD OF THE INVENTION

This invention relates generally to a holder and organizer and more particularly to such a holder which can accommodate a variety of workshop articles such as tools, small parts, bolts, nuts, pencils, rulers, and the like.

BACKGROUND OF THE INVENTION

The prior art abounds with devices for holding and organizing various workshop articles such as tools, small parts, bolts, nuts, screws, pencils, rulers, and the like. Numerous such prior art devices are disclosed in United States patents as exemplified by Patent No. 3,023,891 to Sutter; U.S. Pat. No. 3,737,131 to Larson; U.S. Pat. No. 4,452,361 to Harris; U.S. Pat. No. 5,350,071 to Pond.

While these prior art holders might be utilized to hold an assortment of articles, all suffer from numerous deficiencies and disadvantages. The present invention overcomes these deficiencies and disadvantages in that it provides a new and improved article holder that fills the need for a simple inexpensive holder made from readily available materials and permits the mobility of each holder.

SUMMARY OF THE INVENTION

The holder for assorted workshop articles of the present invention generally comprises a wall hanger, a plurality of insert rings, and a plurality of cup-shaped containers. The items intended to be held by the holder of the present invention include tools, small parts, bolts, nuts, screws, pencils, rulers, and the like.

It is an object of the present invention to provide a new and improved article holder which may be easily and efficiently manufactured from inexpensive and readily available materials and parts and readily adaptable for workshop and other uses.

It is a further object of the present invention to provide a new and improved holder for an assortment of items such as tools, small parts, bolts, nuts, screws, plants and the like which permits the items to be readily accessible and not clutter the workshop or garage.

It is yet a further object of the present invention to provide a new and improved holder for a variety of items which permits the easy mobility of each container.

Other objects, features, and advantages of the present invention will become apparent from the following detailed description and from the appended drawings in which like numbers have been used to designate like parts throughout the several views.

DESCRIPTION OF THE PREFERRED EMBODIMENTS

Figure 1:
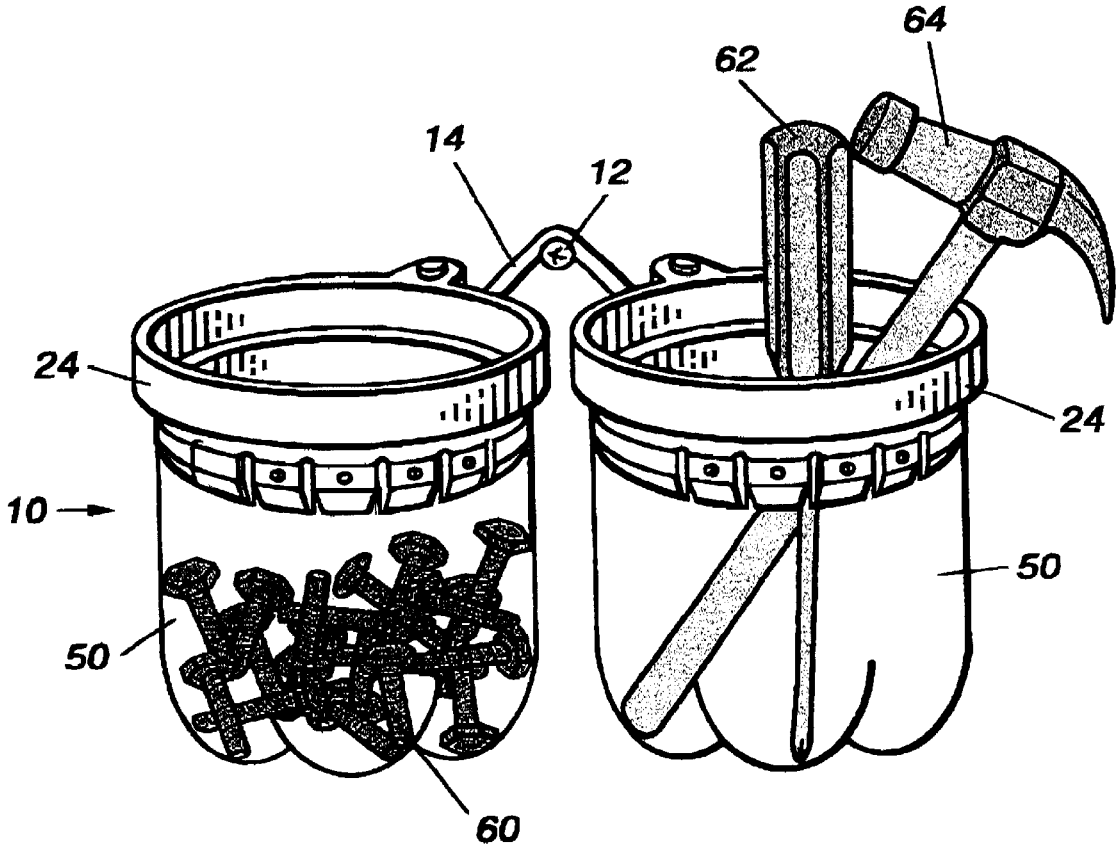
FIG. 1 is a perspective view of the preferred embodiment of the article holder of the present invention having an assortment of instruments therein.
Figure 2:
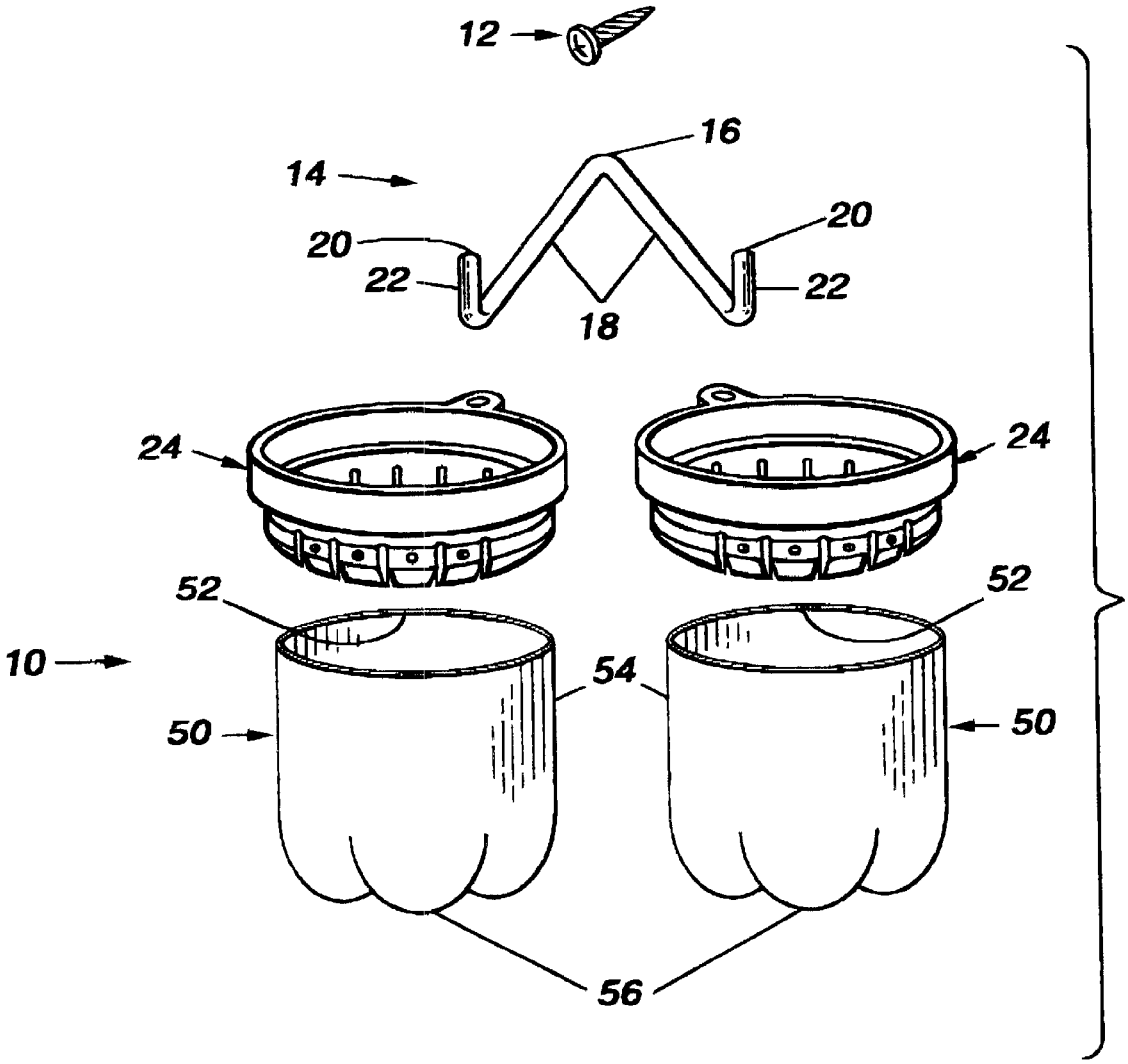
FIG. 2 is an exploded perspective view of the preferred embodiment of the article holder of the present invention.
Figure 3:
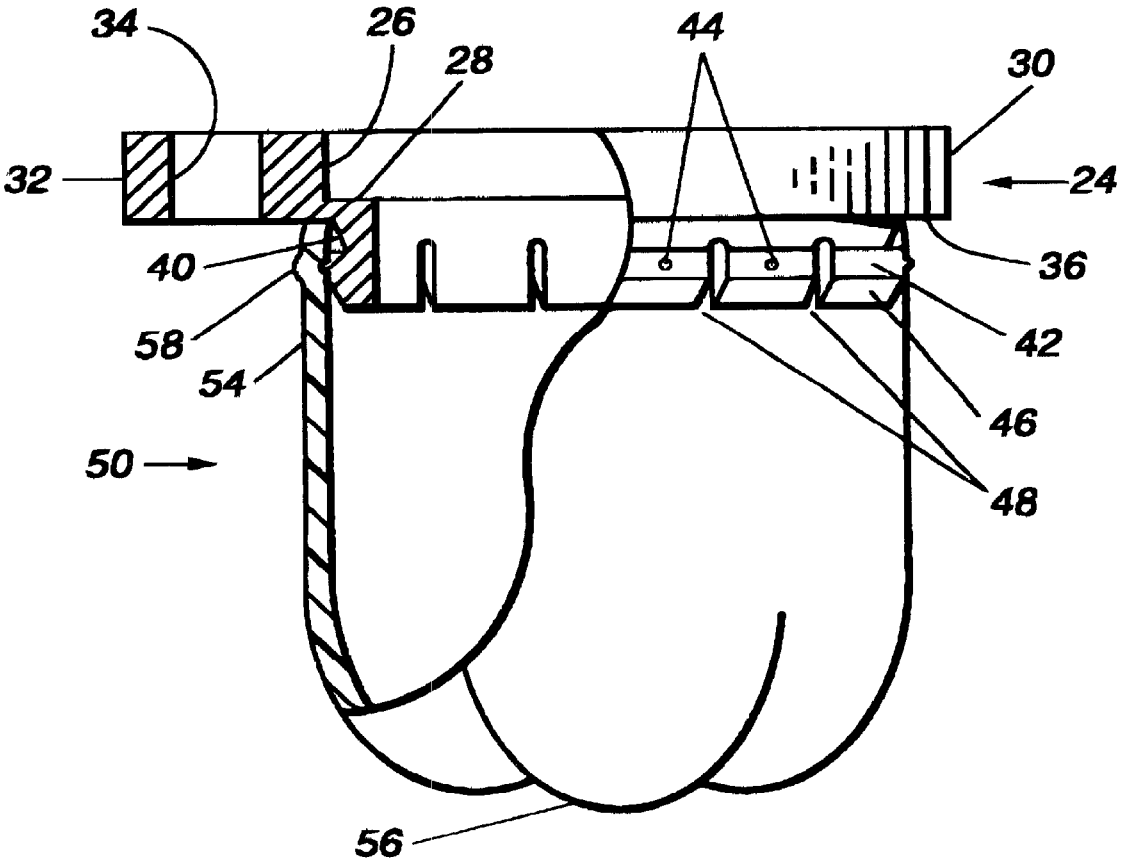
FIG. 3 is a front elevational, partially broken away, and cross-sectional, view of one of the insert rings and one of the containers of the preferred embodiment of the article holder of the present invention.
Figure 4:
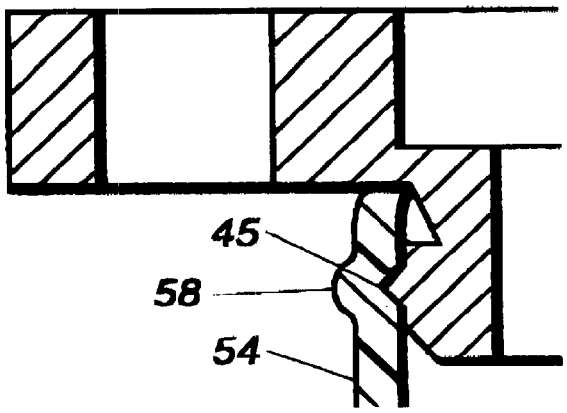
FIG. 4 is a partially enlarged view of a portion of FIG. 3.
Figure 5:
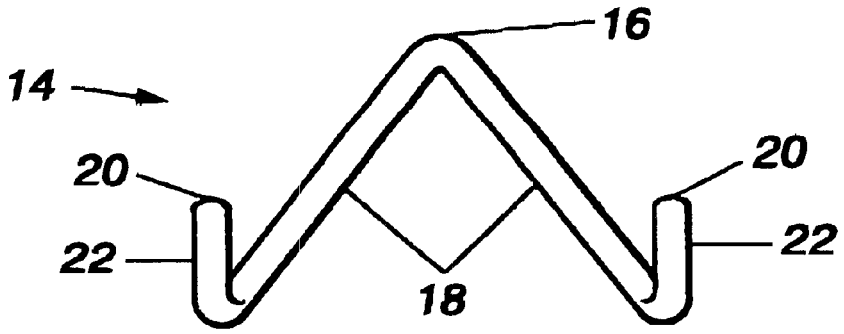
FIG. 5 is a perspective view of the wall hanger used in the present invention.
Figure 6:
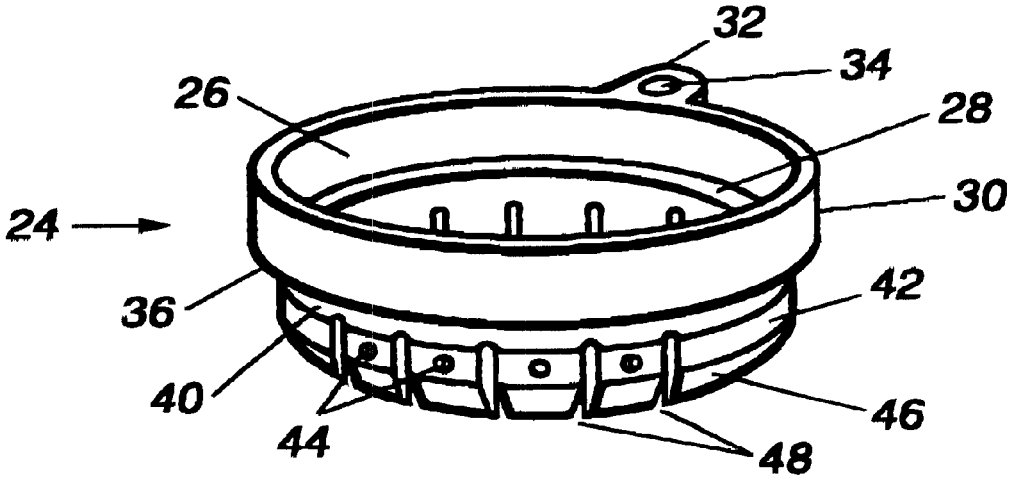
FIG. 6 is a perspective view of the insert ring used in the present invention.
Figure 7:
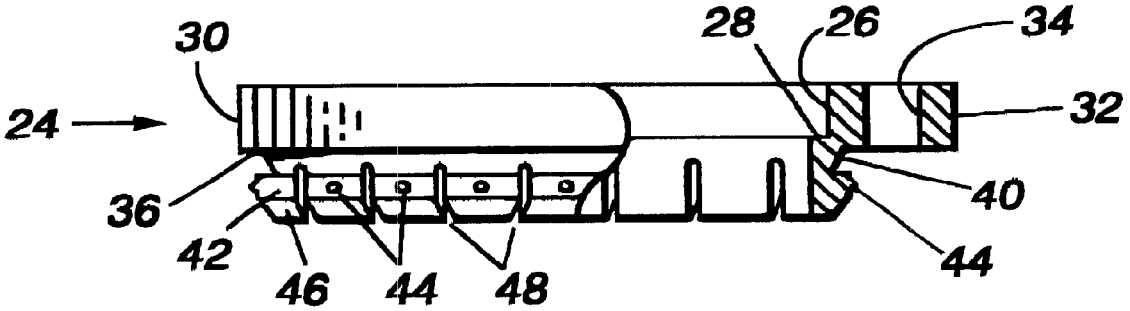
FIG. 7 is a front elevational, partially broken away, and cross-sectional, view of the insert ring used in the present invention.
Figure 8:
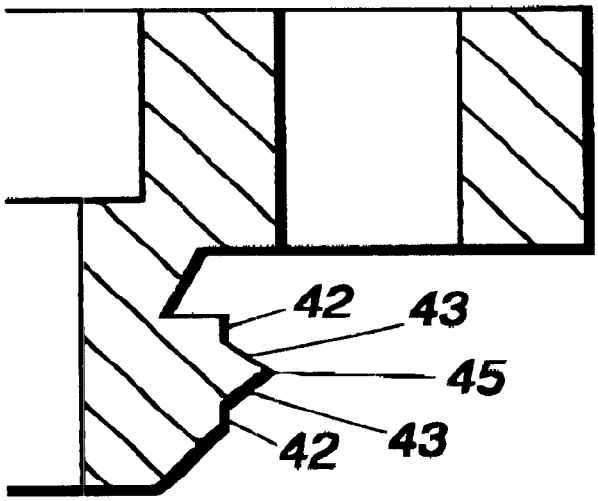
FIG. 8 is a partially enlarged view of a portion of FIG. 7.
Figure 9:
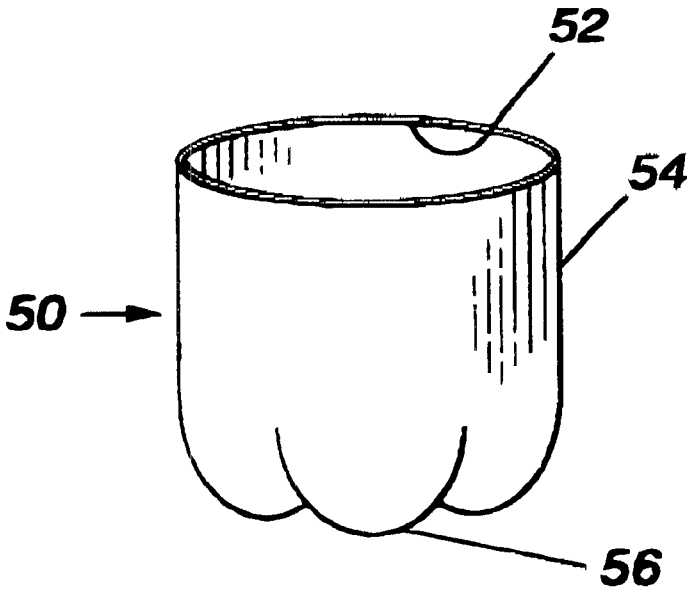
FIG. 9 is a perspective view of the cup-shaped container used in the present invention.

Referring now to the drawings, wherein like numerals represent like parts throughout, reference numeral 10 generally designates the article holder of the present invention. As best seen in FIG. 1, the article holder 10 generally comprises a screw 12, a wall hanger 14, a plurality of insert rings 24, and a plurality of cup-shaped containers 50. As best seen in FIGS. 2 and 5, a wall hanger 14 includes a plurality of prongs 22, prong tips 20, arms or angles 18, and a screw-resting portion 16. As best seen in FIGS. 6 and 7, each insert ring 24 includes a central opening 26; an internal annular shoulder 28; an upper annular portion 30 having a projection 32 with a central opening 34 therein; an external annular shoulder 36; a lower annular portion 42 having a plurality of grippers 44, a tapered section 46, and a plurality of slits 48; and an external annular groove 40. As best seen in FIG. 8, a partially enlarged view of a portion of FIG. 7, the gripper 44 of each insert ring 24 includes the gripper tip 45 and side angles 43. As best seen in FIGS. 2 and 9, each cup-shaped container 50 includes a closed bottom 56, a side wall 54, and an upper opening 52. As best seen in FIGS. 3 and 4, bumps 58 are formed in the upper section 52 of each container 50 by gripper tips 45 on grippers 44. As best seen in FIG. 1, a plurality of articles normally found in the workshop is shown housed in each holder 10. These articles include bolts 60, a screwdriver 62, and a hammer 64.

The holder 10 might be assembled by placing the annular lower portion 42 of an insert ring 24 into the central openings 52 of container 50. The grippers 44 and slits 48 provide resiliency to the annular lower section 42 to enable the insert rings 24 to fit within upper section 52 of containers 50 of varying internal dimensions. Gripper tips 45 penetrate the inner surface of container 50 to form the bumps 58 to secure a respective container 50 to a respective insert ring 24. The containers 50 are attached to the wall hanger 14 by placing the prong tips 20 of the wall hanger 14 in a respective opening 34 of a respective insert ring 24. The fully assembled containers 50 and the wall hanger 14 are then hung on a wall by placing the screw-resting portion 16 of the wall hanger 14 onto a screw or nail 12 attached to the wall. After the holder 10 is assembled as generally explained, articles such as bolts 60, a screwdriver 62, and a hammer 64 can be placed within the cup-shaped containers 50.

The components of the article holder 10 in each embodiment of the invention can be made of plastic except for the wall hanger which can be made of either plastic or metal. The preferred material of each cup-shaped container 50 is a clear or colored transparent plastic which would allow a person to easily see the contents through the outer walls of each container. The preferred material for the insert ring 24 is a clear or colored transparent or solid plastic.

While the above description constitutes the preferred embodiment of the present invention, it will be appreciated that the invention is susceptible to modification, variation, and change without departing from the proper scope and fair meaning of the accompanying claims. For example, the shapes of the insert ring 24 and container 50 can be any shape, such as square, rectangle, oval, or funnel shape.

What I claim as my invention:

1. A holder for a variety of workshop articles, said holder comprising:

a plurality of insert rings, each said insert ring including a central opening, an upper portion having a projection with an opening therein, an external shoulder, and a lower portion having a plurality of grippers and slits;

a plurality of cup-shaped containers, each said container including a closed bottom, a side wall with an inner surface, and an upper opening for receiving said lower portion of a respective said insert ring for securing a respective said cup-shaped container to a respective said insert ring;

a wall hanger including a screw resting portion and a plurality of prongs for insertion in said opening of a respective projection of said insert ring for securing each said insert ring to said wall hanger.

2. The holder of claim 1 wherein said lower portion of each said gripper of each said insert ring includes a gripper tip for partially penetrating said inner surface of a respective said cup-shaped container for securing a respective said container to a respective said insert ring.

3. The holder of claim 2 wherein said lower portion of each said insert ring includes a plurality of slits for enabling said insert ring to fit within said upper section of a respective said cup-shaped container for varying internal dimension.

4. The holder of claim 3 wherein each said cup-shaped container is made of clear transparent plastic so that the workshop articles in each said cup-shaped container can be easily seen.

5. The holder of claim 2 wherein each said gripper tip of each said gripper includes a sharp point.

6. The holder of claim 1 wherein said closed bottom of each said cup-shaped container is funneled-shape.

7. The holder of claim 1 wherein said closed bottom of each said sup-shaped container is flat.

8. The holder of claim 1 wherein each said insert ring and each said cup-shaped container is of one piece and made of transparent plastic.

9. A holder for one or more selected items, said holder comprising:

a plurality of insert rings, each said insert ring including a central opening, an upper portion having a projection with a central opening therein, an external shoulder, and a lower portion with a plurality of grippers and slits;

a plurality of cup-shaped containers, each container including a closed bottom, a side wall including an inner surface, and an upper opening for receiving said lower portion of a respective said insert ring for securing a respective said cup-shaped container to a respective said insert ring, each said gripper of each said insert ring including a sharp point for partially penetrating said inner surface of a respective said cup-shaped container.

10. The holder of claim 9 wherein each said cup-shaped container is made of clear transparent plastic so that the items in each said cup-shaped container can be easily seen.

* * * * *